US006079887A

United States Patent [19]

Koyabu et al.

[11] Patent Number: 6,079,887

[45] Date of Patent: Jun. 27, 2000

[54] PRINTER WITH AN IMPROVED FEEDING SYSTEM

[75] Inventors: Akira Koyabu; Hiroyuki Nakayama; Susumu Hama, all of Nagano-ken, Japan

[73] Assignee: Seiko Epson Corporation, Nagano-ken, Japan

[21] Appl. No.: 09/243,892

[22] Filed: Feb. 3, 1999

Related U.S. Application Data

[62] Division of application No. 08/854,955, May 13, 1997, Pat. No. 5,895,158.

[30] Foreign Application Priority Data

| | | | |
|---|---|---|---|
| May 15, 1996 | [JP] | Japan | 8-120664 |
| May 15, 1996 | [JP] | Japan | 8-120665 |
| May 15, 1996 | [JP] | Japan | 8-120666 |

[51] Int. Cl.[7] ..... B41J 11/42

[52] U.S. Cl. ..... 400/579; 400/607.2

[58] Field of Search ..... 400/595, 599, 400/600, 600.2, 605, 607, 607.2, 608.4, 630, 579

[56] References Cited

U.S. PATENT DOCUMENTS

| | | | |
|---|---|---|---|
| 4,743,129 | 5/1988 | Keryhuel et al. . | |
| 5,000,597 | 3/1991 | Kilb et al. . | |
| 5,026,184 | 6/1991 | Diirr et al. . | |
| 5,061,095 | 10/1991 | Asai et al. | 400/605 |
| 5,149,217 | 9/1992 | Narita . | |
| 5,328,281 | 7/1994 | Narita et al. . | |

FOREIGN PATENT DOCUMENTS

| | | |
|---|---|---|
| 0428163 | 5/1991 | European Pat. Off. . |
| 0519518 | 12/1992 | European Pat. Off. . |
| 0530777 | 3/1993 | European Pat. Off. . |
| 0676295 | 10/1995 | European Pat. Off. . |
| 63-082262 | 4/1988 | Japan . |
| 63-201740 | 12/1988 | Japan . |
| 04191229 | 7/1992 | Japan . |
| 05058525 | 3/1993 | Japan . |
| 05169671 | 7/1993 | Japan . |

*Primary Examiner*—Ren Yan
*Attorney, Agent, or Firm*—Hogan & Hartson LLP

[57] ABSTRACT

A printer having an ink jet type printing section for printing on a first cut sheet of paper having a first shape or a second cut sheet of paper having a second shape. A set of transfer rollers is provided adjacent to an insertion aperture for the first cut sheet of paper and mounted on one end of an open/close lever. Another set of transfer rollers is provided adjacent to a discharge aperture for the first cut sheet of paper. Opening and closing of the transfer rollers adjacent to the insertion aperture and opening and closing of the transfer rollers adjacent to the discharging aperture are performed by a common driving source.

3 Claims, 9 Drawing Sheets

PRINTER WITH AN IMPROVED FEEDING SYSTEM

This is a division of application Ser. No. 08/854,955 filed May 13, 1997, now U.S. Pat. No. 5,895,158, which application is hereby incorporated by reference in its entirety.

BACKGROUND OF THE INVENTION

1. Field of the Invention

The present invention relates to a printer that handles sheets of paper, and more particularly, to a point of sale (POS) printer for printing on sheets of paper, such as, for example, paper slips, bank checks and the like.

2. Description of Related Art

A POP printer typically uses an impact dot method or an ink jet method to print on a sheet of recording paper, and may be used to print on a single sheet of paper (herein after referred to as a cut sheet of paper), such as, for example, a paper voucher, a slip, a bank check or the like. Typically, the printer has a cut-sheet feeding aperture for inserting a cut sheet of paper in the printer. The cut sheet of paper is transferred by rollers disposed adjacent to the cut-sheet feeding aperture to a printing section within the printer. The cut sheet of paper is printed at the printing section and then discharged from the printer through a discharge aperture by the operation of rollers that are disposed adjacent to the discharge aperture. Upon inserting a cut sheet of paper through the cut-sheet feeding aperture, the rollers disposed adjacent to the cut-sheet feeding aperture are separated from each other to facilitate insertion of the cut sheet of paper.

When a calculation result or the like is printed on a relatively large sheet of paper, such as a slip, (herein after referred to as slip printing), using the above-described paper feed path for transferring cut sheets of paper, the slip of paper is transferred through a paper feed path in the following manner. The slip of paper is inserted in the cut-sheet feeding aperture used for slip printing, passed through the printing section, and discharged from the discharge aperture used for slip printing.

On the other hand, the same printer may be used in a different printing operation mode. When printing five or six lines in a predetermined area on a card-shaped sheet of paper such as a bank check for payment validation (herein after referred to as validation printing), the card-shaped sheet of paper is inserted through the discharge aperture used for slip printing to the deepest section of the printing section. Then, the lines are printed on the card-shaped sheet of paper while the card-shaped sheet of paper is transferred back toward the discharge aperture.

For example, FIG. 9 shows an explanatory view of a conventional printer that is capable of validation printing. A print head 4 performs printing on a single slip of paper or a cut sheet of validation paper 500 which is transferred onto a platen 38 by a pair of transfer rollers 19 and 20 and a pair of transfer rollers 21 and 22. The transfer rollers in each pair can open and close with respect to one another.

For printing on a slip of paper 500, the slip of paper 500 is transferred through a slip paper feed path 501. More specifically, the slip of paper 500 is inserted through a sheet insertion aperture 510 defined in the front surface of the printer. Then, the slip of paper 500 is guided by a paper guide 39 onto the platen 38, printed by the print head 4 and discharged through a discharge aperture 520 defined in an upper area of the printer.

When printing on a cut sheet of validation paper 500, the transfer rollers 19 and 20 and the intermediate transfer rollers 21 and 22 are both separated from each other as shown in FIG. 9. After, the cut sheet of validation paper 500 is inserted into a groove section 501*a*, the transfer rollers 19 and 20 and the transfer rollers 21 and 22 are both brought into pressure contact to pinch the cut sheet of validation paper 500. While the cut sheet of validation paper 500 is transferred upwardly toward the discharge aperture 520, the print head 4 prints on the cut sheet of validation paper 500.

The above-described printer suffers from the following problems.

(a) In order to insert a sheet of paper in a variety of forms in the cut paper feed path, the rollers at the insertion side are preferably separated from each other for slip printing and the rollers at the discharge side are preferably separated from each other for validation printing. In a conventional paper feed mechanism of the printer for printing cut sheets of paper, opening and closing of the rollers at the cut sheet insertion side and opening and closing of the rollers at the cut sheet discharge side are independently performed by different power sources (plungers or the like). As a result, the mechanism is complicated and independent control circuits are required for the respective power sources. Furthermore, the printer shown in FIG. 9 requires an additional mechanism for opening and closing the intermediate transfer rollers 21 and 22 in addition to the mechanism for the rollers 19 and 20 at the cut sheet paper discharge side to allow insertion of the cut sheet of validation paper 500.

(b) In the POS printer of the type described above, a sheet of paper must be inserted in an appropriate aperture depending on the specified purpose and use. Therefore, the POS printer may have a plurality of apertures for inserting and discharging sheets of paper. In some cases, one aperture may be commonly used for inserting and discharging sheets of paper. As a result, sheets of paper can be wrongly inserted by mistake.

There is another type of POS printer that prints on a sheet of recording paper in a roll (herein after referred to as a rolled sheet of paper) for printing receipts in addition to printing on a cut sheet of paper. In this type of POS printer, a portion of the paper feed path for cut sheets of paper is used as a paper feed path for the rolled sheet of paper, and each type of paper is transferred to a common printing section. As described above, the paper feed path is formed in a manner that each different type of paper is transferred to a different discharging aperture. As a consequence, the number of apertures for inserting and discharging sheets of paper is increased, and more errors during operation and insertion are likely to occur.

(c) In general, sheets of validation paper may have a variety of different qualities. For example, there are thick, sturdy sheets of paper, thin, weak sheets of paper, copy papers formed from a plurality of laminated thin sheets of paper and the like. In order to smoothly insert and transfer a sheet of validation paper that may vary in qualities, shapes and types, a transfer path for the validation paper is preferably formed straight. In order to form a straight paper feed path, a straight groove section, such as the groove 501*a* of FIG. 9, must be formed for positioning the bottom edge of the validation paper, as shown in FIG. 9, in addition to the paper feed path 501 for transferring slips of paper.

When the paper feed path is formed in this manner and if the sheet of validation paper is curved, the sheet of the validation paper may not correctly enter the groove section 501*a*, and may instead enter the slip paper feed path 501 for transferring slips of paper, as shown in the broken line in FIG. 9. If printing is started with a sheet of validation paper being set at a wrong position, then the initial position of the sheet of validation paper deviates from the designed initial position, and therefore printing may not likely be performed at a specified location. Accordingly, a mechanism for preventing such a problem may be additionally required, and thus the paper feed system and the control of the paper feed system become more complicated.

SUMMARY OF THE INVENTION

It is an object of the present invention to provide a printer with a simple structure that correctly guides sheets of paper of a variety of different types.

It is another object of embodiments of the present invention to provide a printer that handles sheets of paper of a variety of types and that is capable of opening and closing the sheet transfer rollers for transferring cut sheets of paper by a single source of power. As a result, insertion of sheets of paper of a variety of types is facilitated and error insertion of sheets of paper of a variety of types is substantially prevented.

In accordance with one embodiment of the present invention, a printer for printing on a sheet of paper includes at least a pair of first transfer rollers disposed in a sheet insertion side and a pair of second transfer rollers disposed in a sheet discharging side. Open/close operation of the first transfer rollers and open/close operation of the second transfer rollers are associated with one another and performed by a single driving source. As a result, a plurality of rollers can be opened and closed by a single driving source, and thus the open/close mechanism and the open/close control are simplified.

In accordance with another embodiment of the present invention, the printer includes a link movement mechanism for maintaining the second transfer rollers in a closed state when the first transfer rollers are placed in an open state by the driving source, and maintaining the first transfer rollers in a closed state when the second transfer rollers are placed in an open state. The printer has a discharge aperture that is commonly used as an aperture for discharging a sheet of paper for slip printing and an insertion aperture for inserting a sheet of paper for validation printing. By this structure, for example, when performing slip printing, only the first rollers at the sheet insertion side are separated from each other so that a sheet of paper for slip printing can be inserted. At this moment, the second rollers, that are disposed adjacent to the discharge aperture, are maintained in a closed state. As a result, a sheet of paper for validation printing is not inserted in the printer by mistake. On the other hand, when performing validation printing, the first rollers are closed and the second rollers are separated from each other, and thus a sheet of paper for slip printing is not inserted in the printer by mistake.

In accordance with another embodiment of the present invention, the printer has third rollers disposed intermediate to the first rollers and the second rollers and a printing section for printing on the sheet of paper disposed intermediate to the second rollers and the third rollers. By disposing the third rollers at the above-described location, the following paper transfer operation is achieved. After a sheet of paper for slip printing is inserted, the first rollers are closed and the sheet of paper is transferred by the first rollers. When the sheet of paper reaches the third rollers, the sheet of paper can be transferred by the third rollers. When the sheet of paper is further transferred and reaches the second rollers, the first rollers are opened and the second rollers are closed so that the sheet of paper can be transferred by the second rollers. In other words, when the cut sheet of paper is longer than both the distance between the first rollers and the third rollers and the distance between the second rollers and the third rollers, the cut sheet of paper can be transferred through the paper feeding path. Further, if the above condition is met, then the entire surface of a very short sheet (cut sheet) of paper can be printed. Moreover, the number of rollers that simultaneously pinch and drive the sheet of paper is always two pairs or less. Therefore, problems in feeding sheets of paper are substantially eliminated. For example, wrinkles that may be formed in a sheet of paper by pinching the sheet of paper by too many rollers do not likely occur, and thus the sheet of paper is securely transferred.

In accordance with another embodiment of the present invention, the printer can selectively print on a sheet of paper that is inserted in an area on the side of the first rollers and on a card-shaped sheet of paper that is inserted in an area on the side of second rollers to an area adjacent to the third rollers. The printer has a common aperture disposed adjacent to the second rollers for discharging the sheet of paper and for inserting the card-shaped sheet of paper. As a result, the common aperture commonly serves as a discharge aperture for slip printing and an insertion aperture for validation printing. Accordingly, the structure of the printer is simplified.

In accordance with another embodiment of the present invention, the printer includes a form stopper for positioning a leading end of the sheet of paper inserted from the side of the first rollers. The form stopper is capable of projecting into and receding from a paper feeding path. The projecting and receding operation of the form stopper is performed in association with the open/close operation of the first rollers by a single driving source. In other words, the operation of the form stopper to position the sheet of paper is associated with the open/close operation of the rollers, and these operations are performed by the single driving source. Accordingly, the structure is further simplified.

In accordance with one embodiment of the present invention, the printer includes a paper feed path for transferring a sheet of paper that is provided in a roll, and a common printing section for printing on a cut sheet of paper as well as on a sheet of paper in a roll.

In the printer having the structure described above, the first rollers are maintained in an open state and the second rollers are maintained in a closed state when printing on the sheet of paper in a roll. As a result, while the second rollers are closed and the first rollers are opened upon printing on the sheet of paper in a roll, the form stopper is protruded and thus a cut sheet of paper cannot be inserted in the printing section. In this manner, when printing on a sheet of paper in a roll, the paper feed path for cut sheets of paper is closed on the side of the first rollers and on the side of the second rollers. Accordingly, a cut sheet of paper cannot be inserted by mistake.

Further, in the printer having the structure described above in accordance with one embodiment of the present invention, one of the pair of the first transfer rollers and the pair of the second transfer rollers have a fixed-side roller supported by a frame and a shifting-side roller supported by a lever that is rotatably mounted on the frame. The shifting-side roller comes in contact with and separates from the fixed-side roller in association with the rotational movement of the lever. A drive pulley is preferably mounted at a pivot point of the lever, and the drive pulley and the shifting-side roller are coupled by a belt under a tension so that driving force is transferred from the drive pulley to the shifting-side roller through the belt. As a result, when the lever that supports the transfer roller is rotated, the distance between the pivot point of the transfer roller and the pivot point of the driving pulley does not change so that the tension of the belt connecting the transfer roller and the driving pulley remains constant. Accordingly, the driving force is securely transferred to the transfer roller, and each cut sheet of paper is transferred at a precise designed sheet transfer pitch. A tension adjusting pulley is preferably mounted on the lever for adjusting the tension of the belt. Since the pulley moves together with the lever, when the tension of the belt is adjusted, the adjusted tension does not change due to the rotational movement of the lever.

In accordance with another embodiment of the present invention, the printer for printing on a sheet of paper has a feed opening for a first sheet of paper, a discharge opening for a first sheet of paper and a paper feeding path that allows insertion of a second sheet of paper through the discharge opening for the first sheet of paper. A stopper is provided in the paper feeding path that allows passage of a first sheet of paper fed through the feed opening for a first sheet of paper but stops a second sheet of paper by the edge of the paper fed through the discharge opening. As a result, a groove structure for positioning the bottom edge of a sheet of validation paper is not required in the paper feed path, and a leading end of a sheet of validation paper does not enter the paper feed path for transferring cut sheets of paper. As a consequence, sheets of validation paper are accurately positioned.

In a preferred embodiment, the stopper may be mounted on a common axis that mounts transfer rollers provided intermediate of the paper transfer path. Such a structure shortens the distance between a position where a second sheet of paper for validation printing is pinched by the transfer rollers provided adjacent to the discharge aperture and a position where the first sheet of paper abuts the stopper. As a result, a sheet of relatively soft paper can readily pass. Also, a sheet of paper for slip printing is transferred free of trouble in the case of slip printing.

In one embodiment, the printer has a printer upper section defining a discharge opening and a printer front section defining an insertion opening. The paper feed path of the printer is formed at least from a straight section having one end extending to the discharge opening provided in the printer upper section and a curved section connecting to the other end of the straight section and extending to the insertion opening provided in the printer front section. In a preferred embodiment, the stopper or the transfer rollers formed on the common axis of the stopper is provided adjacent to an area where the straight section connects to the curved section. As a result, a sheet of validation paper can be inserted into and transferred through a straight paper transfer path (straight path). As a result, sheets of validation paper of a variety of types can be smoothly inserted and transferred and accurately set in a printing position without paper jamming or the like.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings.

PREFERRED EMBODIMENTS

A printer in accordance with an embodiment of the present invention will be described below in detail with reference to FIGS. 1–8.

Figure 1:
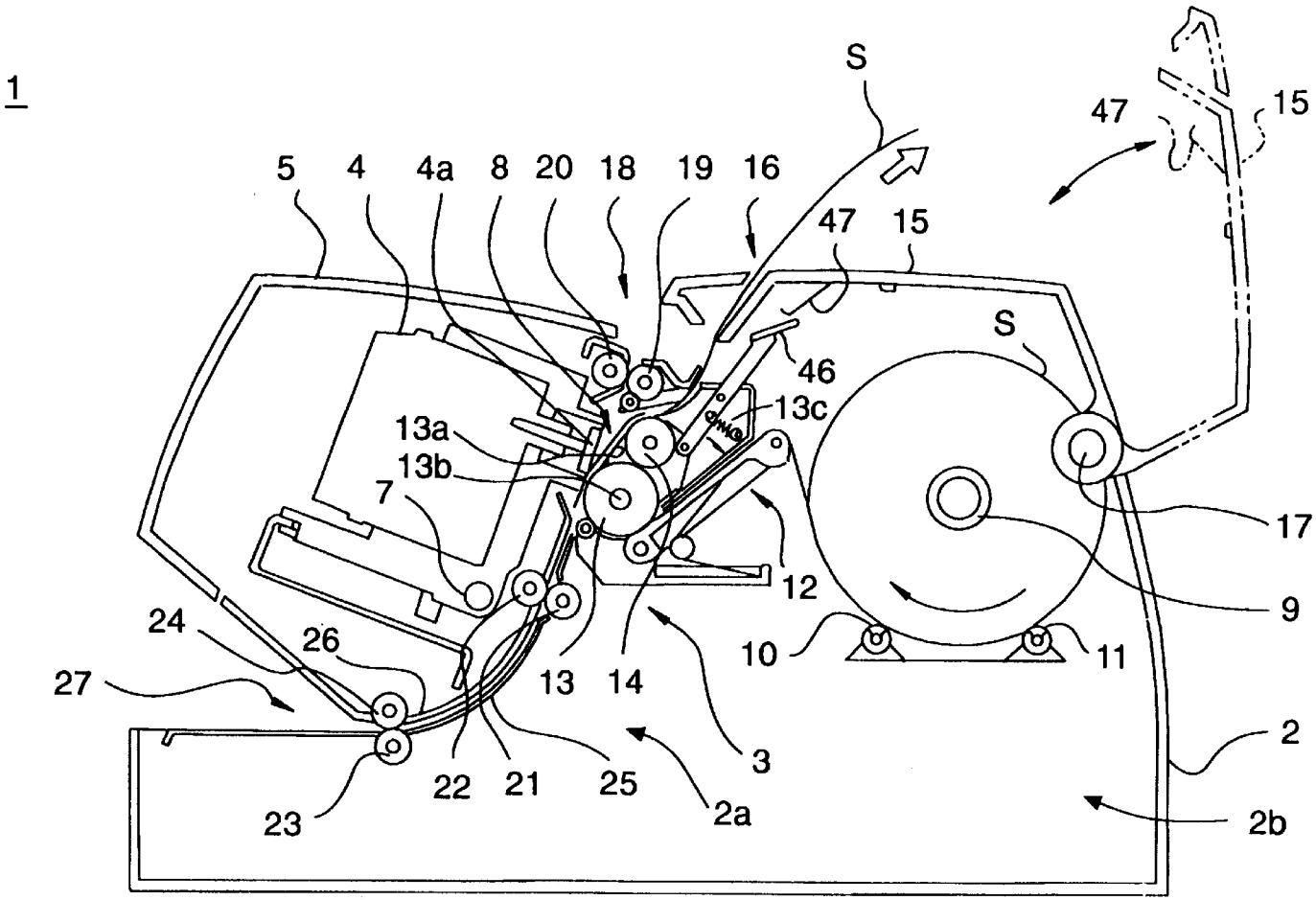
FIG. 1 schematically shows a cross-sectional view of an internal structure of a printer in accordance with one embodiment of the present invention.
Figure 2:
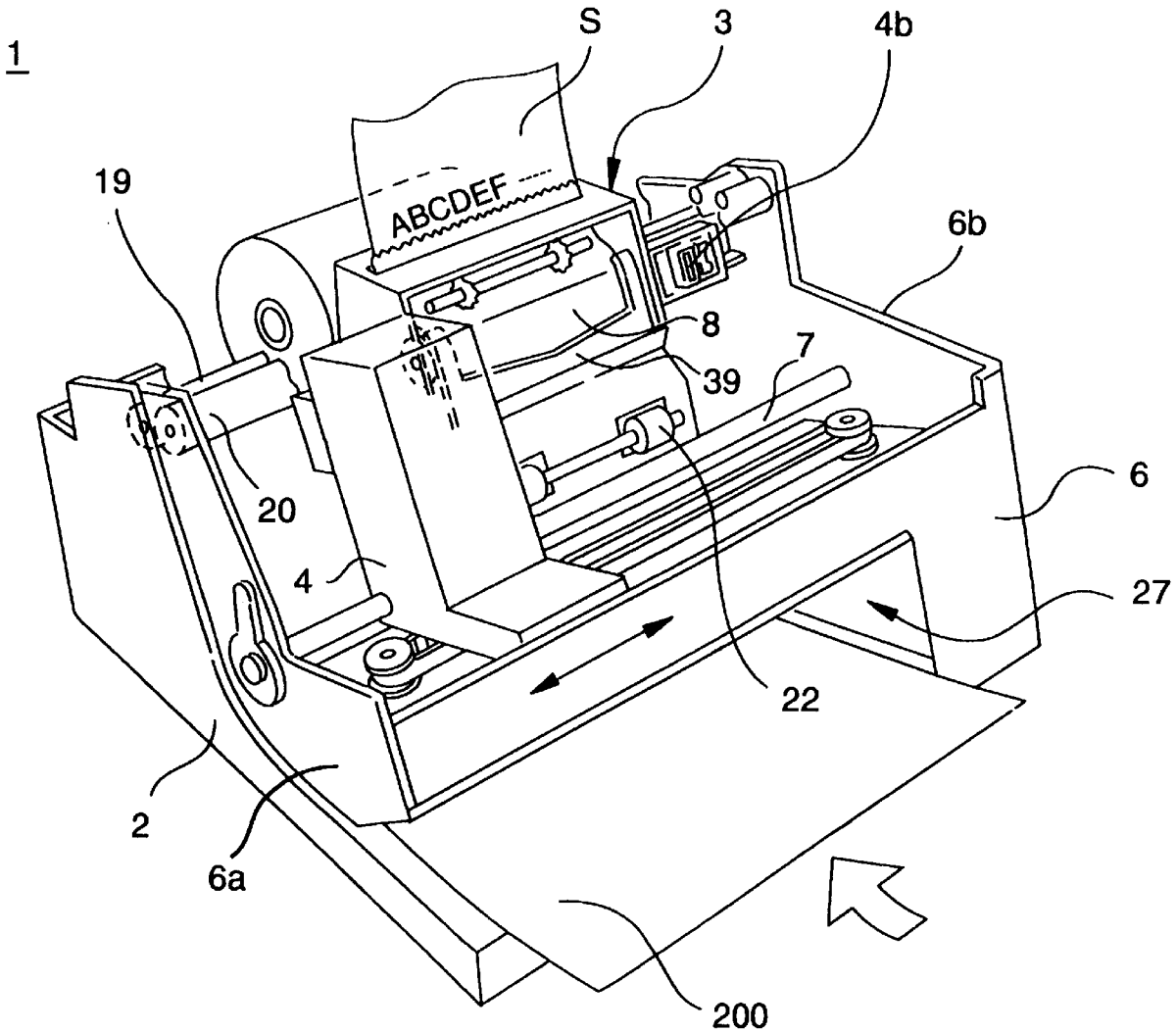
FIG. 2 shows a frontal perspective view of an interior structure of the printer shown in FIG. 1 in accordance with one embodiment of the present invention.

FIGS. 1 and 2 show an overall structure of a printer 1. FIG. 1 schematically shows an internal structure of the printer 1, and FIG. 2 shows a frontal perspective view of the interior of the printer 1 shown in FIG. 1.

As shown in FIG. 1, the printer 1 in accordance with the illustrated embodiment has a main body cover 2 that is made of, for example, a resin, a metal material or the like. The main body cover 2 of the printer 1 defines a front section 2*a* and a rear section 2*b*. A roll of paper S is disposed in the rear section 2*b* and inside the main body cover 2. A paper transfer section 3 for transferring the rolled paper S is mounted in the front section 2*a* of the main body cover 2.

A printing section 4 having an ink jet system for printing on the rolled paper S is disposed adjacent to the paper transfer section 3 in front of the paper transfer section 3. The printing section 4 is covered by a main body front cover 5 that is made of a resin, a metal material or the like.

It is noted that the rolled paper S, the paper transfer section 3 and the printing section 4 are mounted on a frame 6 that is made of metal, a resin or the like.

The printing section 4 in accordance with one embodiment performs printing by using a known ink jet method. Any one of the other printing methods, such as, for example, a dot impact printing method, may also be used for printing. As shown in FIG. 2, a guide rail 7 is fixed to the main body frame 6, and the printing section 4 is moveably mounted on the guide rail 7 so that the printing section 4 is capable of moving between side sections 6*a* and 6*b* of the main body frame 6 along the guide rail 7.

As shown in FIG. 1, an ink jet head 4*a* of the printing section 4 is disposed opposite to a platen section 8 that is provided in the paper transfer section 3.

Also, as shown in FIG. 2, a capping apparatus 4*b* is disposed at a position adjacent to the paper transfer section 3. When printing is not performed for a predetermined period, the printing section 4 is moved to the front of the capping apparatus 4*b*, and a nozzle of the ink jet head 4*a* is covered by the capping apparatus 4*b*. Accordingly, when printing is not performed for an extended period of time, the nozzle of the ink jet head 4*a* is prevented from drying.

The rolled paper S is rotatably supported by a pair of support rollers 10 and 11 disposed in parallel with a roll core section 9 of the rolled paper S. A leading end of the rolled paper S is drawn from the lower side of the printer apparatus toward the upper side.

A transfer path for the rolled paper S is formed in the paper transfer section 3. In the illustrated embodiment, the rolled paper S is guided and transferred by a paper guide section 12 and a transfer roller 13 onto the platen 3. After printing on the rolled paper S by the printing section 4, the rolled paper S is further transferred by a transfer roller 14 and discharged through a discharge opening 16 defined in a main body upper cover 15. When a cut sheet of paper (described below) is not inserted, the rolled paper S can be printed.

As shown in FIG. 1, the main body upper cover 15 is rotatably mounted about a pivot axis 17. In order to facilitate insertion of the rolled paper S, the platen section 8 is designed to move closer to and farther from the ink jet head 4*a* in association with the open and close operation of the main body upper cover 15. In the illustrated embodiment, the platen section 8 and the transfer roller 14 are supported on a frame 13*a* which is rotatably supported about an axis 13*b* of the transfer roller 13. The frame 13*a* is connected to a lever 46 and is forced by a spring 13*c* mounted on the lever 46 in a direction in which the platen section 8 and the transfer roller 14 are moved away from the ink jet head 4*a*. With this mechanism, when the main body upper cover 15 is closed, a pressure lever 47 fixed to the interior of the main body upper cover 15 pushes an upper section of the lever 46, and the platen section 8 is moved closer to the ink jet head 4*a* into a position where printing can be performed. On the other hand, when the main body upper cover 15 is opened as the rolled paper S is set in position, the pressure of the pressure lever 47 is released from the lever 46. As a result, the platen section 8 is moved away from the ink jet head 4*a* and is placed in a receded position by the resilient force of the spring 13*c* that is mounted on the lever 46. Consequently, the leading end of the rolled paper S is smoothly guided pass the printing section to the discharge aperture 16.

The main body upper cover 15 and the main body front cover 5 define a discharge aperture 18 in the upper central area of the main printer body for discharging a cut sheet of paper 200 on which slip printing is performed. As described below, the discharge aperture 18 commonly serves as an insertion aperture for validation printing. A pair of transfer rollers 19 and 20 (second transfer rollers) is disposed adjacent to the discharge aperture 18. Further, a pair of transfer rollers 21 and 22 (third transfer rollers) is disposed between the paper transfer section 3 and the printing section 4, and a pair of transfer rollers 23 and 24 (first transfer rollers) is disposed under the printing section 4. In embodiments of the present invention, each of the transfer rollers 19, 20, 21, 22, 23 and 24 may be composed of any appropriate number of rollers, for example, one roller, two rollers, three rollers or the like.

These transfer rollers 19, 20, 21, 22, 23 and 24, and a pair of upper and lower guide members 25 and 26 define a paper transfer path for transferring the cut sheet of paper 200. As shown in FIG. 2, when slip printing is performed, a cut sheet of paper for slip printing is inserted through a paper insertion aperture section 27.

Figure 3:
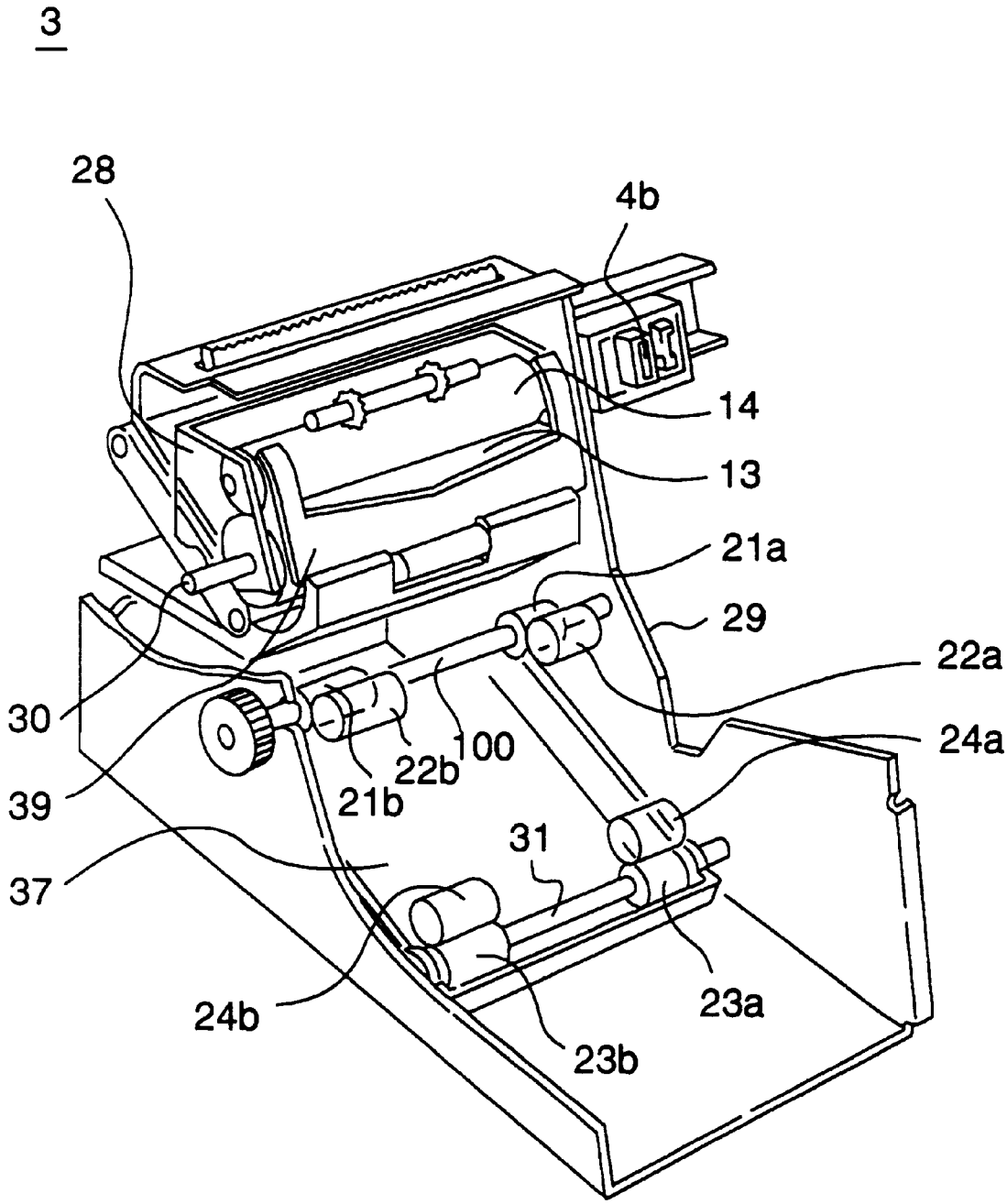
FIG. 3 shows a perspective view of a paper transfer section of the printer shown in FIG. 1 in accordance with one embodiment of the present invention.
Figure 4:
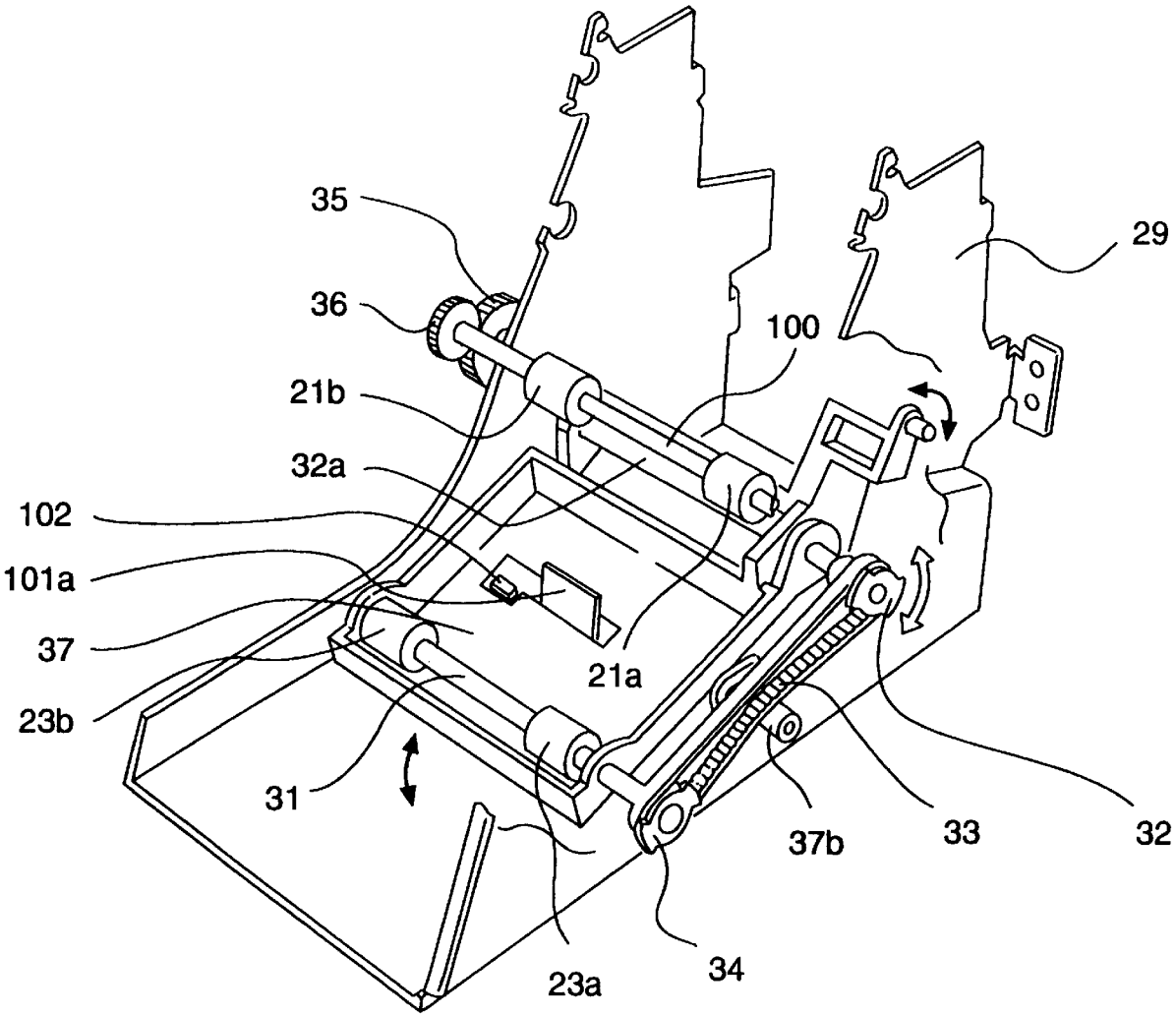
FIG. 4 shows a perspective view of a transfer roller drive mechanism of the printer shown in FIG. 1 for transferring cut sheets of paper in accordance with one embodiment of the present invention.

FIGS. 3 and 4 show the paper transfer section 3 in a preferred embodiment. As shown in FIGS. 3 and 4, the transfer rollers 13 and 14 for transferring a rolled sheet of paper S are mounted on a metal support frame 28 in the shape of a square channel. The support frame 28 is mounted on a metal transfer frame 29 that forms at least a part of the paper transfer path for cut sheets of paper. The transfer roller 13 for transferring a rolled paper S is formed from a material that is not slippery, such as, for example, rubber or the like, and has a driving shaft 30 that is coupled to a driving motor (not shown). The transfer roller 13 and the transfer roller 14 are rotated in the same direction by a gear system (not shown). The support frame 28 is rotatably mounted about the driving shaft 30 of the transfer roller 13.

As shown in FIG. 3, first transfer rollers 23*a* and 23*b* for transferring a cut sheet of paper are mounted on a shaft 31 that is rotatably mounted on an open/close lever 37. Also, third transfer rollers 21*a* and 21*b* are mounted on a shaft 100 that is rotatably mounted on the transfer frame 29.

As shown in FIG. 4, the first transfer rollers 23*a* and 23*b* are rotated by a drive pulley 32 that is driven by a motor (not shown), a belt 33 and a follower pulley 34. The third transfer rollers 21*a* and 21*b* are rotated by a gear 35 that is driven by the same motor (that drives the drive pulley 32) and a gear 36 that engages the gear 35. The open/close lever 37 is rotatably mounted on the transfer frame 29 about a shaft 32*a* having the drive pulley 32 mounted on one end of the shaft 32*a* and the gear 35 on the other end.

Figure 5:
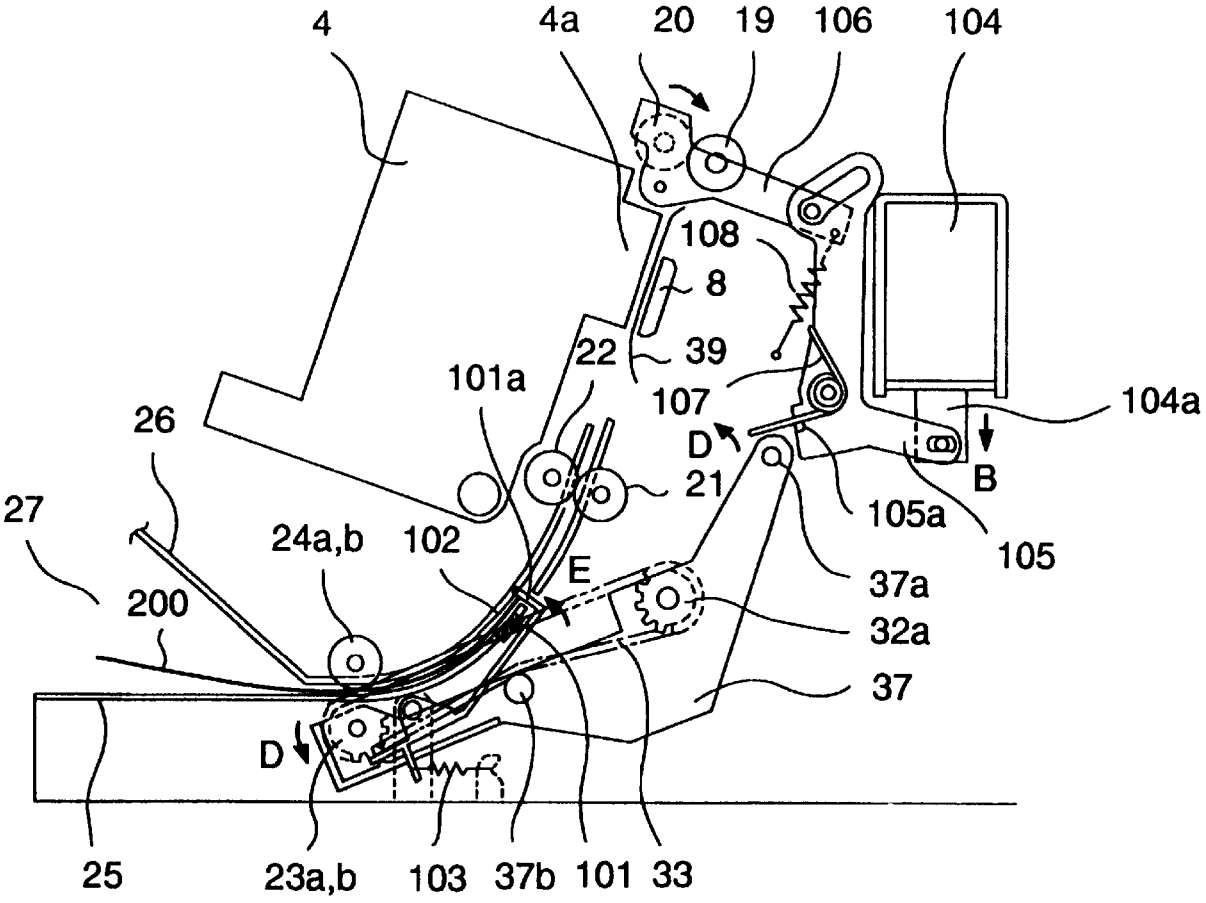
FIG. 5 shows a side view of a transfer system of the printer shown in FIG. 1 for transferring cut sheets of paper in operation in accordance with one embodiment of the present invention.
Figure 6:
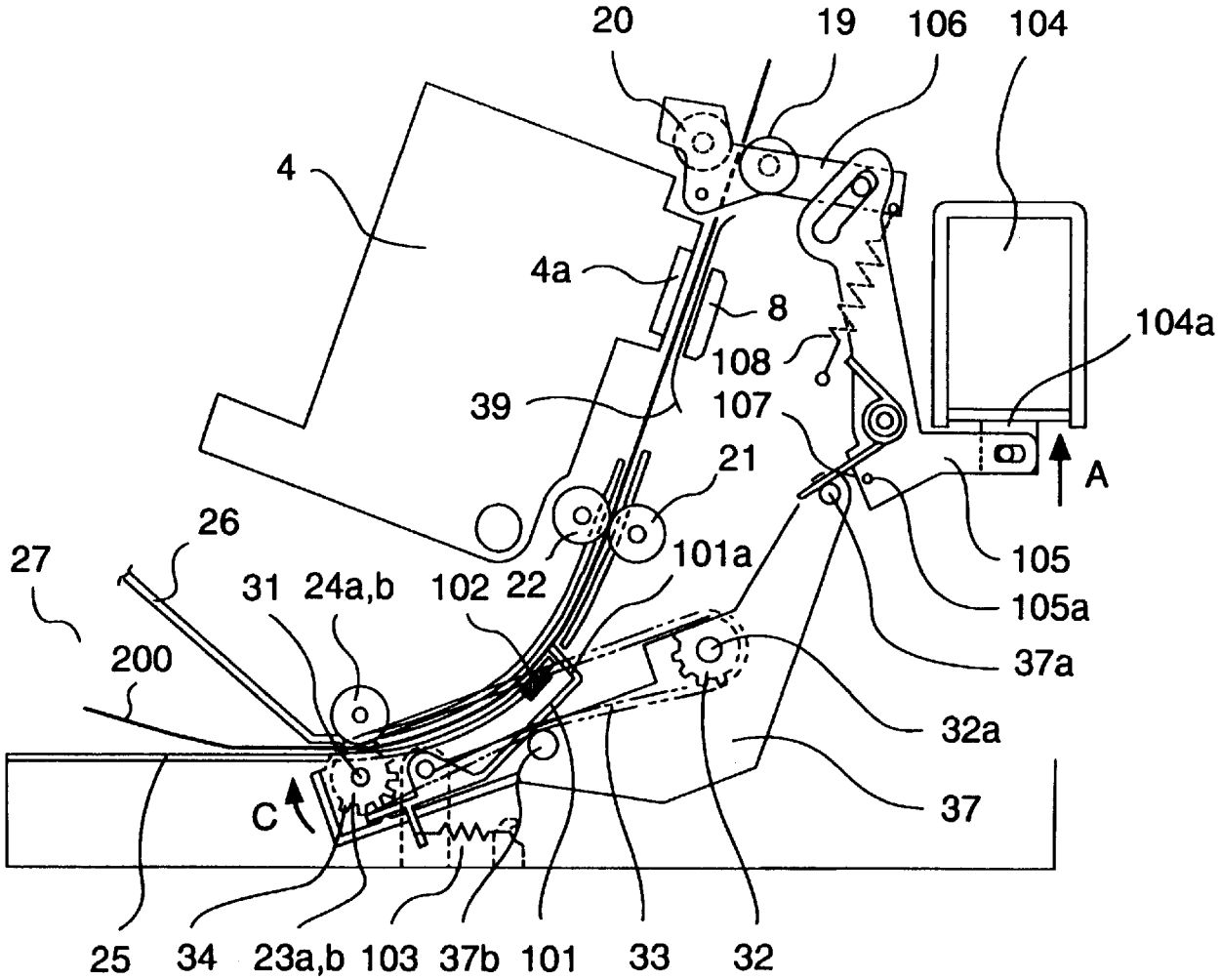
FIG. 6 shows a side view of a transfer system of the printer shown in FIG. 1 for transferring cut sheets of paper in operation in accordance with one embodiment of the present invention.

Referring to FIGS. 5 and 6, a cut sheet transfer mechanism and its operation in the case of slip printing will be described. It is noted that the rolled sheet transfer mechanism shown in FIG. 1 is not shown in FIGS. 5 and 6. It is also noted that the transfer rollers 23*a* and 23*b*, the transfer rollers 24*a* and 24*b*, the transfer rollers 21*a* and 21*b*, and the transfer rollers 22*a* and 22*b* may be simply referred to as the transfer rollers 23, the transfer rollers 24, the transfer rollers 21 and the transfer rollers 22, respectively, for the simplicity of description.

The paper insertion aperture section 27 is defined by the upper and lower guide members 25 and 26 and guides a cut sheet of paper 200. When a cut sheet of paper 200 is inserted, the transfer rollers 23*a* and 23*b* are separated from the transfer rollers 24*a* and 24*b*, and do not prevent insertion of the cut sheet of paper 200. At this moment, a tip section 101*a* of a form stopper 101 protrudes from the lower guide member 25 into the paper transfer path by the resilient force of a spring 103. When the cut sheet of paper 200 is inserted, the leading end of the cut sheet of paper 200 is stopped at a position corresponding to the form stopper 101. A paper detector 102 is provided generally at the same location of the tip section 101*a* of the form stopper 101. The paper detector 102 detects insertion of the cut sheet of paper 200.

The detector 102 also detects the trailing end of the cut sheet of paper 200. Therefore, the detector 102 is used to determine, for example, the bottom margin of a cut sheet of paper (a printing position of the last line) that is pre-set prior to printing. As shown in FIG. 5, when the transfer rollers 23*a* and 23*b* are separated from the transfer rollers 24*a* and 24*b*, the transfer roller 20 is brought in pressure contact with the transfer roller 19. Therefore, the cut sheet of paper 200 cannot be inserted from the side of the discharge opening 18.

When the cut sheet of paper 200 stops at the form stopper 101, and the paper detector 102 detects that the sheet of paper is set in position, a controller section (not shown)

activates a plunger 104 so that an iron core 104*a* of the plunger 104 moves in the direction of an arrow A, as shown in FIG. 6. By this operation, the paper discharging transfer roller 20 is separated from the transfer roller 19 by the operation of levers 105 and 106. At the same time, a spring 107 pushes a pin 37*a* of the open/close lever 37. As a result, the open/close lever 37 rotates about the shaft 32*a* in the direction of an arrow C, as shown in FIG. 6, and the transfer rollers 23*a* and 23*b* are brought into pressure contact with the rollers 24*a* and 24*b* with the cut sheet of paper 200 being pinched between the rollers 23*a* and 23*b* and the rollers 24*a* and 24*b*. In other words, the rollers 23*a* and 23*b* are pushed against the rollers 24*a* and 24*b* by the resilient force of the spring 107.

At this moment, the form stopper 101 rotates against the spring force of the spring 103 in association with the motion of the open/close lever 37 that rotates in the direction of the arrow C, and thus the tip section 101*a* is lowered below the lower guide member 25.

Then, the transfer rollers 23*a*, 23*b*, 24*a* and 24*b* are driven to transfer sheet of paper 200 toward the ink jet head 4*a* of the printing section 4. The rotation of the drive pulley 32 mounted on the shaft 32*b* is transferred through the belt 33 to the follower pulley 34 that is mounted on the same shaft 31 of the transfer rollers 23*a* and 23*b* so that the transfer rollers 23*a* and 23*b* are rotated. The tension of the extended belt 33 is adjusted by finely adjusting the position of an adjusting pulley 37*b* that is mounted on a portion of the open/close lever 37. In a preferred embodiment, the tension of the belt 33 is factory-adjusted to an appropriate level.

As the cut sheet of paper 200 is advanced by the rotation of the rollers 23*a*, 23*b*, 24*a* and 24*b*, the cut sheet of paper 200 is introduced between the intermediate transfer rollers 21*a*, 21*b* and transfer rollers 22*a*, 22*b*. The intermediate transfer rollers 21*a*, 21*b* and the corresponding transfer rollers 22*a*, 22*b* are always in pressure contact with each other. Rotational force of the drive motor (not shown) is transferred through the drive shaft 32*a* and the gears 35 and 36 to the intermediate transfer rollers 21*a*, 21*b* and the rollers 22*a*, 22*b*. The cut sheet of paper 200, that is transferred by the rollers 21*a*, 21*b* and the rollers 22*a*, 22*b*, and the rollers 23*a*, 23*b*, and the rollers 24*a*, 24*b*, is introduced between the guide member 39 and the ink jet head 4*a*, and desired characters are printed on the cut sheet of paper 200. In a preferred embodiment, while the unshown drive motor for driving the transfer rollers is stopped, the ink jet head 4*a* is moved along the guide rail 7 to print one line of characters. Then, the transfer rollers are driven to move the cut sheet of paper 200 by a predetermined amount (for printing a next line), and then printing is performed by the ink jet head 4*a* again. These operation steps are repeated.

After the cut sheet of paper 200 has passed the area between the guide member 39 and the ink jet head 4*a*, the cut sheet of paper 200 is introduced between an open space between the discharge transfer rollers 19 and 20.

A feeding amount from a position at which the cut sheet of paper 200 abuts the tip section 101*a* of the form stopper 101 to a position at which the cut sheet of paper 200 reaches the open space between the discharge transfer rollers 19 and 20 is preset by the controller section that controls the motor for driving these transfer rollers. In other words, when the cut sheet of paper 200 is transferred by the pre-set feeding amount, the cut sheet of paper 200 reaches the space between the transfer rollers 19 and 20.

At this moment, the plunger 104 is activated so that the iron core 104*a* moves in the direction of an arrow B, as shown in FIG. 5, to move the levers 105 and 106. As a result, the roller 20 is brought into pressure contact with the roller 19 and the leading end of the cut sheet of paper 200 is pinched by the rollers 19 and 20. Accordingly, the cut sheet of paper 200 can be transferred by the rollers 19 and 20. The pressure force acting between the rollers. 19 and 20 is determined by the spring 108. When the iron core 104*a* of the plunger 104 moves in the direction of the arrow B, an abutting section 105*a* of the lever 105 pushes up the spring 107. As a result, the spring 107 is released from the pin 37*a* of the lever 37, and the resilient force of the spring 107 that acts to bring the rollers 23*a* and 23*b* in pressure contact with the rollers 24*a* and 24*b* is removed. The open/close lever 37 rotates about the shaft 32*a* in the direction of an arrow D, as shown in FIG. 5, due to the weight of the rollers 23*a* and 23*b*.

As a result, the pressure contact between the transfer rollers 23*a* and 23*b* and transfer rollers 24*a* and 24*b* is released, and the rollers 23*a* and 23*b* are separated from the rollers 24*a* and 24*b*. In this state, the cut sheet of paper is transferred by the rotation of two pairs of the transfer rollers 19 and 20 and the transfer rollers 21 and 22.

Also, at this moment, the spring force of the spring 103 forces the tip section 101*a* of the form stopper 101 to protrude above the lower guide member 25 into the paper feed path. However, since the spring force of the spring 103 is set to be very weak, the tip section 101*a* cannot push up the cut sheet of paper 200 and does not prevent the cut sheet of paper 200 from advancing.

As described above, when slip printing is performed on a cut sheet of paper, the cut sheet of paper is transferred by the transfer rollers 23 and 24 immediately after the cut sheet of paper is inserted. When the leading end of the cut sheet of paper has passed the transfer rollers 21 and 22, the cut sheet of paper is transferred by two pairs of the transfer rollers 23 and 24 and the transfer rollers 21 and 22. When the leading end of the cut sheet of paper has reached the transfer rollers 19 and 20, the cut sheet of paper is transferred by two pairs of the transfer rollers 19 and 20 and the transfer rollers 21 and 22. When the trailing end of the cut sheet of paper has passed the transfer rollers 21 and 22, the cut sheet of paper is transferred only by the transfer rollers 19 and 20.

By the paper transfer system described above, even a very short cut sheet of paper is accurately transferred when the cut sheet of paper is longer than both the distance between the rollers 23 and 24 and the rollers 21 and 22 and the distance between the rollers 21 and 22 and the rollers 19 and 20. Furthermore, two or less pairs of the rollers pinch and transfer a cut sheet of paper during the paper transfer operation. As a result, problems that may arise in feeding cut sheets of paper are substantially eliminated. For example, wrinkles that may be formed in a sheet of paper by pinching the sheet of paper by too many rollers do not likely occur, and therefore the sheet of paper is securely and smoothly transferred.

Next, a transfer mechanism and an operation for transferring cut sheets of paper in the case of validation printing will be described below in detail. Validation printing by a printer in accordance with one embodiment of the present invention is performed in the following manner. While the transfer rollers 19 and 20 are separated, a paper slip, such as, for example, a bank check, is inserted through the discharge aperture 18 for slip printing up to an area adjacent to the transfer rollers 21 and 22. After setting the paper slip in position, the plunger 104 is activated by a specified command or a specified key operation to bring the transfer rollers 19 and 20 in pressure contact. After the transfer rollers 19 and 20 pinch the paper slip, the printing head 4*a* is operated to print on the paper slip, and the transfer rollers 19 and 20 are driven on demand so that the paper slip is transferred back toward the discharge aperture 18.

When a paper slip can be inserted for validation printing, the transfer rollers 23 and 24 are closed, and therefore a slip of paper for validation printing cannot be inserted through the paper insertion aperture section 27 by mistake.

Figure 7:
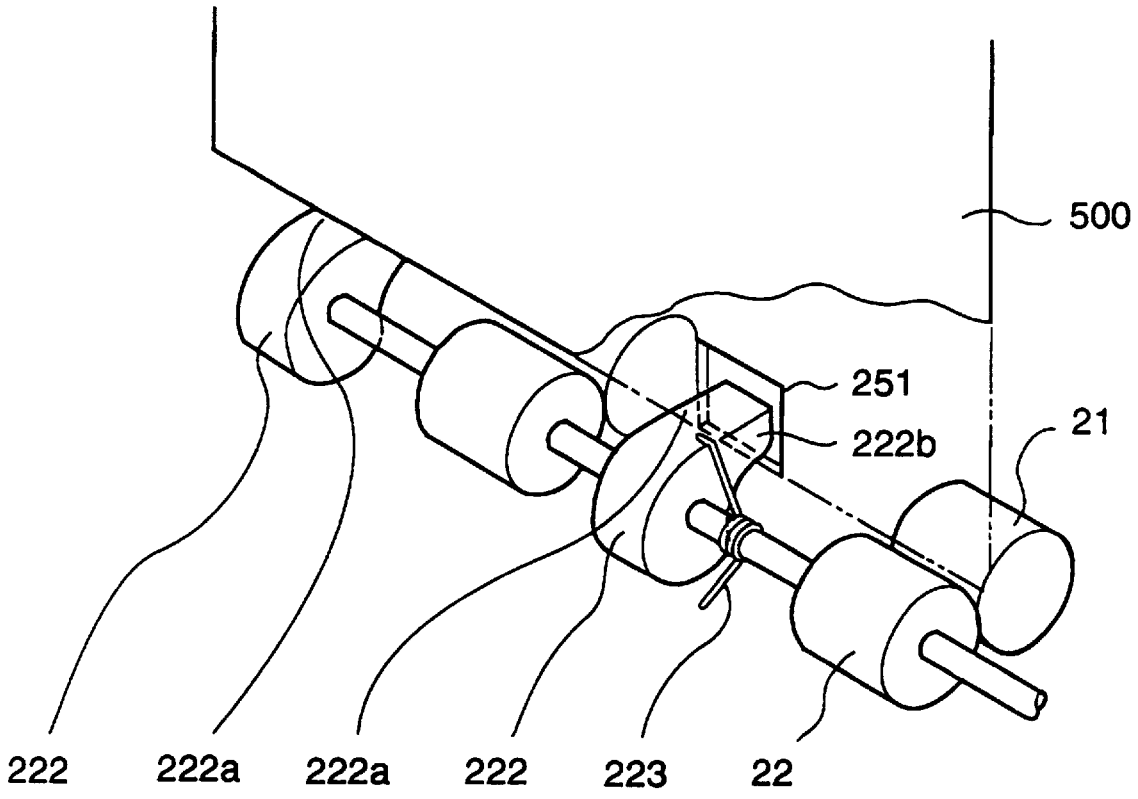
FIG. 7 shows a side view of a validation stopper of the printer shown in FIG. 1 in operation in accordance with one embodiment of the present invention.
Figure 8:
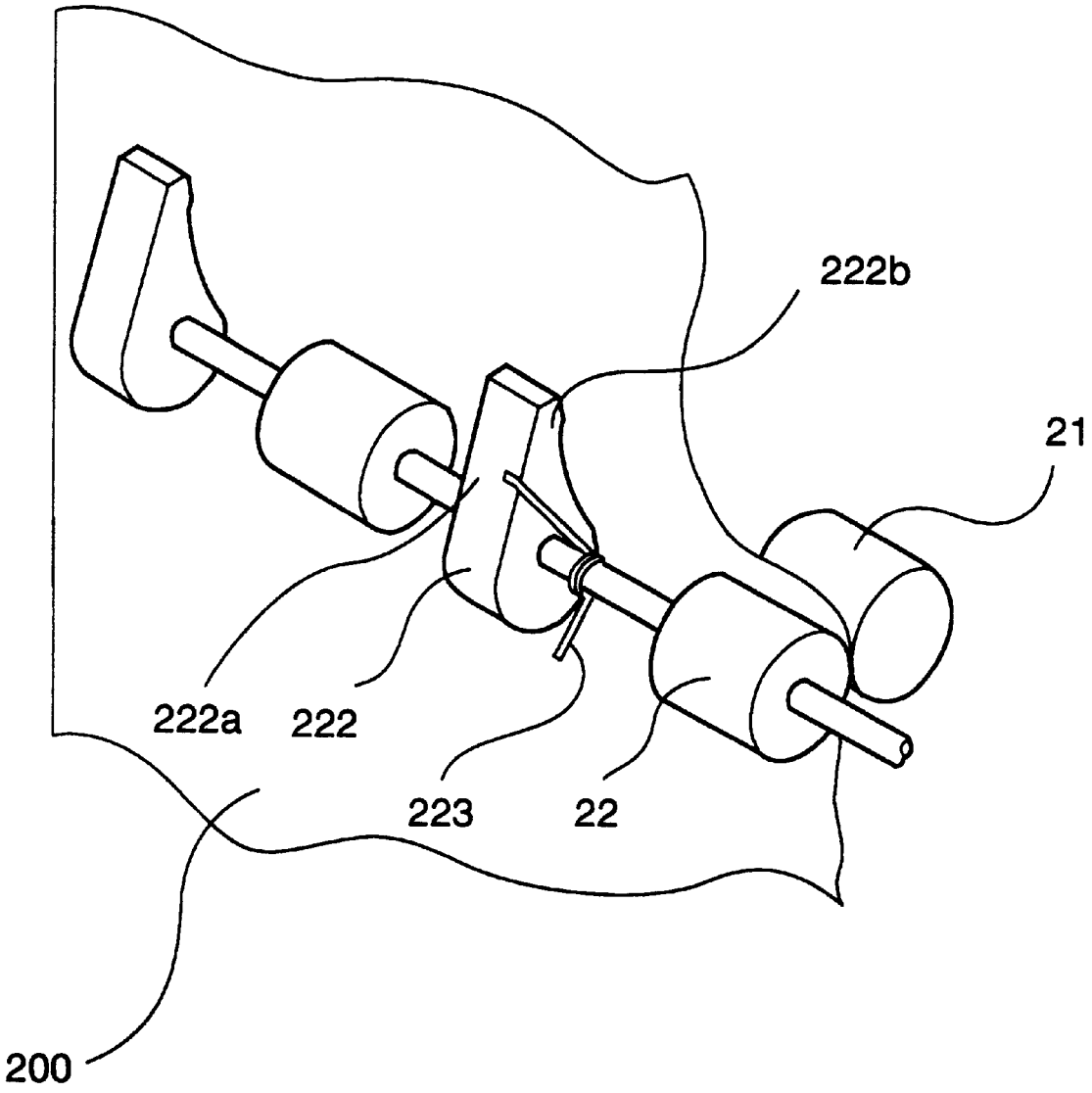
FIG. 8 shows a side view of a validation stopper of the printer shown in FIG. 1 in operation in accordance with one embodiment of the present invention.
Figure 9:
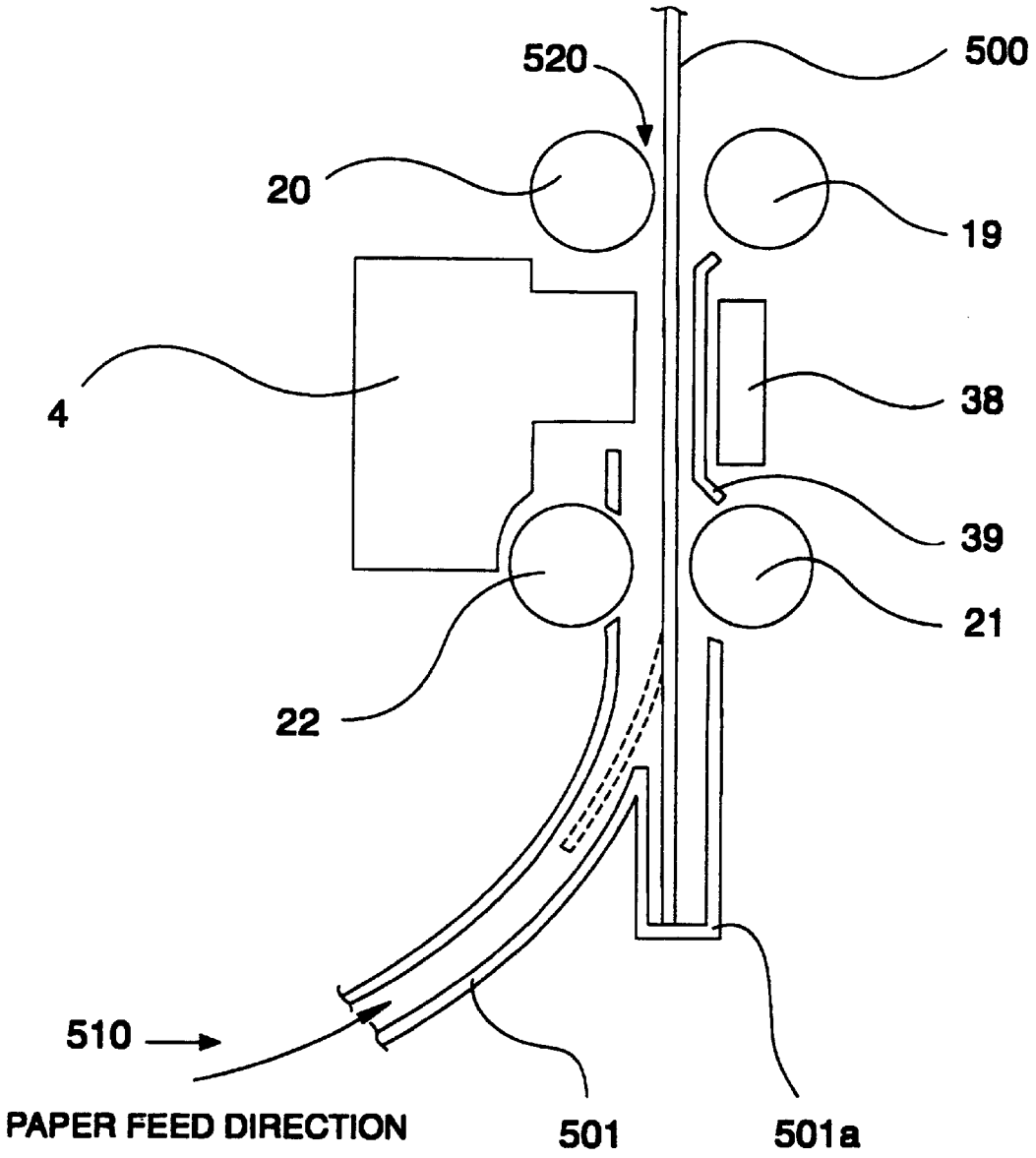
FIG. 9 (PRIOR ART)
FIG. 9 shows a side view of a conventional printer structure for positioning a sheet of validation paper.

FIGS. 7 and 8 show perspective views of an area adjacent to the intermediate rollers 20 and 21. FIG. 7 shows a state where a piece of paper 500 for validation printing is inserted, and FIG. 8 shows a state where a cut sheet of paper 200 for slip printing is inserted.

A plurality of validation stoppers 222 are rotatably mounted on the same shaft that mounts the intermediate transfer roller 22. A spring 223 applies a relatively weak spring force to each of the validation stoppers 222 and forces each of the validation stoppers 222 in a direction in which a protruded section 222*b* of the validation stopper 222 is pushed toward a window 251 that is defined in a paper guide (for example, the upper paper guide and lower paper guide 26 and 25 of FIG. 1), and an upper surface 222*a* of the validation stopper 222 closes the paper feed path.

When the piece of paper 500 for validation printing is inserted through the discharge aperture 18 while the rollers 19 and 20 are opened, the leading end of the piece of paper 500 abuts the upper surface 222*a* of the validation stopper 222 so that the piece of paper 500 is set in an initial position, as shown in FIG. 7. At this moment, the leading end of the piece of paper 500 does not contact the transfer rollers 21 and 22. Then, the plunger 104 is activated to bring the transfer rollers 20 and 19 into pressure contact, the transfer rollers 20 and 19 are driven on demand and the piece of paper 500 is printed.

On the other hand, as shown in FIG. 8, when the cut sheet of paper 200 for slip printing is inserted through the paper insertion aperture section 27, the leading end of the cut sheet of paper 200 passes the transfer rollers 21 and 22, pushes up the protruded section 222*b* of the validation stopper 222. As a result, the validation stopper 222 rotates in a direction in which the paper feed path is opened. By this operation, the cut sheet of paper for slip printing 200 can be transferred further upward. In accordance with an embodiment of the present invention, the validation stopper 222 is provided on the same shaft of the transfer roller 21 or the transfer roller 22. This results in a shorter distance between the location where a cut sheet of paper is pinched by the transfer rollers 21 and 22 and the location where the cut sheet of paper abuts the validation stopper 222. As a result, even a very weak sheet of paper can be readily transferred, and sheets of paper in slip printing are transferred without any problems.

In a preferred embodiment, the plunger is a self-maintained type plunger that performs pulling or returning of the iron core 104*a* by an electric current to be applied for only a predetermined period of time. As a result, power consumption by the printer is lowered.

Preferably, when the rolled paper S is printed, the transfer rollers 23 and 24 remain opened and the transfer rollers 19 and 20 remain closed. As a result, when printing on the rolled paper S, the transfer rollers 19 and 20 are closed, and therefore a cut sheet of paper for validation printing cannot be inserted in the printing section. Also, even though the transfer rollers 23 and 24 are opened, the tip section 101*a* of the form stopper 101 protrudes in the paper feed path. As a consequence, a sheet of paper for slip printing cannot be inserted in the printing section. In this manner, when printing on the rolled paper S, the paper insertion aperture section 27 and the discharge aperture 18 of the paper feed path for cut sheets of paper are closed with respect to the printing section. Therefore, a cut sheet of paper cannot be inserted by mistake while printing on the rolled paper.

In accordance with an embodiment of the present invention, the plunger is operated by specified commands or key operation to separate the rollers 19 and 20 from each other and bring the rollers 19 and 20 in pressure contact. As a result, the printing section and a part of the paper feed path for slip printing are commonly used for validation printing in which one type of cut sheet of paper is inserted for printing through discharge aperture that is used for discharging another type of cut sheet of paper. Moreover, by using the paper feed system described above, a variety of different modes of printing operation can be provided for a variety of different modes of usage and different types of paper. Also, during a specified print mode, a sheet of paper for a different print mode cannot be inserted by mistake.

It should be noted that the present invention is not limited to the embodiment described above, and a variety of modifications are implemented.

For example, in the above-described embodiment, the description is made with reference to a printer that incorporates an ink jet type printing head. However, the present invention is not limited to this particular embodiment, and the present invention is also applicable to a printer having any one of various printing heads, such as a dot impact type printing head and the like.

Furthermore, the present invention is not limited to a printer for printing bills or bank checks, but is also applicable to other types of printers.

As described above, in a printer for printing on a sheet of paper in accordance with the above-described embodiment of the present invention, the printer has at least a pair of first transfer rollers and a pair of second transfer rollers disposed in an insertion side and in a discharging side, respectively. Open/close operation of the first transfer rollers and open/close operation of the second transfer rollers are associated with one another and performed by a single driving source. As a result, the open/close mechanism and the open/close control are simplified.

The printer includes a link movement mechanism for maintaining the second transfer rollers in a closed state when the first transfer rollers are placed in an open state by the driving source, and maintaining the first transfer rollers in a closed state when the second transfer rollers are placed in an open state. The second transfer rollers are preferably provided adjacent to a discharge aperture in the discharging side. The discharge aperture is used for discharging sheets of paper for slip printing and commonly serves as an aperture for inserting sheets of paper for validation printing. By this structure, for example, when performing slip printing, only the first rollers in the insertion side are separated from each other so that a sheet of paper for slip printing can be inserted through the insertion aperture. At this moment, the second rollers, that are disposed adjacent to the discharge aperture and that commonly serves as an aperture for inserting sheets of paper for validation, are maintained in a closed state. As a result, a sheet of paper for validation printing cannot be inserted in the printer through the discharge aperture by mistake. On the other hand, when performing validation printing, the first rollers are closed and the second rollers are opened, and thus a sheet of paper for slip printing cannot be inserted in the printer through the insertion aperture by mistake.

Furthermore, third rollers are disposed intermediate to the first rollers and the second rollers and a printing section for printing on the sheet of paper is disposed intermediate to the second rollers and the third rollers. As a result, when a cut sheet of paper is longer than both the distance between the first rollers and the third rollers and the distance between the second rollers and the third rollers, the the cut sheet of paper can be transferred through the paper transfer path, and even the entire surface of a very short sheet (cut sheet) of paper can be printed. Moreover, two or less sets of rollers normally pinch and drive a sheet of paper while the sheet of paper is transferred through the paper feed path. As a result, problems that may arise in transferring cut sheets of paper by many transfer rollers are substantially eliminated. For example, wrinkles may be formed in a sheet of paper by pinching the sheet of paper by too many rollers while the sheet of paper is transferred. Because the number of rollers for transferring a sheet of paper is substantially reduced in accordance with one embodiment of the present invention, formation of wrinkles in the sheet of paper is substantially reduced, and therefore the sheet of paper is securely and smoothly transferred.

The printer allows a sheet of paper for slip printing to be inserted from the side of the first rollers and a card-shaped sheet of paper for validation printing to be inserted from the side of the second rollers to an area adjacent to the third rollers. In accordance with one embodiment of the present invention, the printer can selectively print on a sheet of paper that is inserted in the printer from the side of the first rollers and a card-shaped sheet of paper that is inserted from the side of the second rollers.

The printer has a common aperture disposed adjacent to the second rollers for discharging a sheet of paper for slip printing and inserting a card-shaped sheet of paper for validation printing. As a result, the common aperture serves as a discharge aperture for slip printing and an insertion aperture for validation printing. Accordingly, the structure of the printer is simplified, and error insertion of sheets of paper is prevented.

The printer includes a form stopper for positioning a leading end of a sheet of paper inserted from the side of the first rollers. The form stopper is capable of projecting into and receding from a paper feeding path. The projecting and receding operation of the form stopper is performed in association with the open/close operation of the first rollers, and these operations are performed by a single driving power source. In other words, the operation of the form stopper for positioning a sheet of paper for slip printing is associated with the open/close operation of the rollers and performed by a single driving source. Accordingly, the paper feed structure is further simplified.

Furthermore, the printer has a paper feed path for transferring a sheet of paper that is provided in a roll, and a common printing section for printing on a cut sheet of paper as well as on a sheet of paper in a roll. With the structure described above; the first rollers are maintained in an open state and the second rollers are maintained in a closed state when printing on the sheet of paper in a roll. As a result, while the second rollers are closed and the first rollers are opened upon printing on the sheet of paper in a roll, the form stopper is protruded in the paper feed path. As a result, the paper feed path for cut sheets of paper is closed on the side of the first rollers and on the side of the second rollers with respect to the printing section. Accordingly, a cut sheet of paper cannot be inserted by mistake when printing on the sheet of paper in a roll.

Also, the printer has a stopper provided in the paper feeding path that allows passage of a sheet of paper for slip printing that is inserted through the insertion aperture for slip printing and stops a sheet of paper for validation printing by an edge of the sheet of paper for validation printing that is inserted through the discharge aperture for slip printing. As a result, a groove for positioning the bottom edge of a sheet of validation paper is not required in the paper feed path, and a leading end of a sheet of validation paper cannot enter the paper feed path for transferring cut sheets of paper for slip printing. As a consequence, a sheet of validation paper is accurately positioned with a relatively simple structure.

Furthermore, the stopper may be formed on a common axis that mounts transfer rollers which are provided intermediate to the paper feed path. This structure shortens the distance between a position where a sheet of paper for validation printing is pinched by the transfer rollers and a position where the leading end of the sheet of paper for validation paper abuts the stopper. As a result, a relatively weak sheet of paper for validation printing can readily pass through the paper feed path, and also, a sheet of paper for slip printing can be transferred free of troubles in the case of slip printing.

Moreover, in accordance with one embodiment of the present invention, the paper feed path is formed from a straight section and a curved section connecting to the straight section, and the stopper or the transfer roller formed on the common axis of the stopper is provided adjacent to an area where the straight section connects to the curved section. As a result, a sheet of validation paper can be inserted into and transferred through a straight paper transfer path (straight path). As a consequence, sheets of validation paper in a variety of types are smoothly inserted and accurately set in position, and transferred free of problems, such as, paper jamming or the like.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A printer for printing on a sheet of paper, the printer comprising:

a first opening for a first sheet of paper at a portion in the vicinity of a printing section;

a second opening for a first sheet of paper;

a paper feeding path that allows insertion of a second sheet of paper through the second opening for the first sheet of paper;

a stopper selectively movable into and out of the paper feeding path to allow passage of a first sheet of paper fed through the first opening for a first sheet of paper but to stop passage of a second sheet of paper fed through the second opening for a first sheet of paper; and a transfer roller device provided in the paper feed path and a common shaft mounting the stopper and the transfer roller device.

2. A printer as defined in claim 1, further comprising a printer upper section defining a discharge opening and a printer front section defining an insertion opening, wherein the paper feed path is formed from a straight section having one end extending to the discharge opening provided in the printer upper section and a curved section connecting to another end of the straight section and communicating with the insertion opening provided in the printer front section, wherein the stopper is provided adjacent to an area where the straight section connects to the curved section.

3. A printer as defined in claim 1, further comprising a printer upper section defining a discharge opening and a printer front section defining an insertion opening, wherein the paper feed path is formed from a straight section having one end extending to the discharge opening provided in the printer upper section and a curved section connecting to the other end of the straight section and communicating with the insertion opening provided in the printer front section, and the transfer roller device mounted on the common axis is provided adjacent to an area where the straight section connects to the curved section.

* * * * *

UNITED STATES PATENT AND TRADEMARK OFFICE
CERTIFICATE OF CORRECTION

PATENT NO : 6,079,887

DATED : June 27, 2000

INVENTOR(S): Akira KOYABU et al.

It is certified that error appears in the above-identified patent and that said Letters Patent are hereby corrected as shown below:

Specification:

(1) Column 9, line 21 after "transfer" insert --the cut--
(2) Column 12, line 14 after "through" insert --the--

Signed and Sealed this

First Day of May, 2001

*Attest:*

Nicholas P. Godici

NICHOLAS P. GODICI

*Attesting Officer*

*Acting Director of the United States Patent and Trademark Office*